United States Patent [19]

Bartlett

[11] Patent Number: 4,633,045

[45] Date of Patent: Dec. 30, 1986

[54] DIFFERENTIAL MICROPHONE

[75] Inventor: Bruce Bartlett, Elkhart, Ind.

[73] Assignee: Crown International, Inc., Elkhart, Ind.

[21] Appl. No.: 701,386

[22] Filed: Feb. 13, 1985

[51] Int. Cl.[4] ..... H04R 1/34

[52] U.S. Cl. ..... 381/155; 381/159

[58] Field of Search ..... 179/121 D, 121 R, 179, 179/180; 381/87, 88

[56] References Cited

U.S. PATENT DOCUMENTS 2,529,467 11/1950 Wiggins ..... 179/121 D 3,201,516 8/1965 Weingartner ..... 179/121 D 4,156,800 5/1979 Sear et al. ..... 179/121 D 4,456,796 6/1984 Nakagawa et al. ..... 179/121 D

*Primary Examiner*—Gene Z. Rubinson

*Assistant Examiner*—Danita R. Byrd

*Attorney, Agent, or Firm*—Thomas J. Dodd

[57] ABSTRACT

A differential microphone which includes a plate positioned between and spanning the sound-receiving opening of the microphone. Carried by the plate is a transducer having opposed sound entries surrounded by one or more bores which extend through the plate. The plate serves to delay sound reception at one transducer sound entry.

3 Claims, 5 Drawing Figures

DIFFERENTIAL MICROPHONE

SUMMARY OF THE INVENTION

This invention relates to a differential microphone and will have specific but not limited application to a hand-held microphone.

Differential (or noise-cancelling) microphones are desirable commodities because of their ability to reduce the amplification of distant unwanted sounds. Previously, differential microphones have been produced by providing multiple inlet openings in the microphone head in an effort to reduce unwanted noise. Such microphones as shown in U.S. Pat. Nos. 2,529,467; 3,201,516; and 4,456,796; and in the publication, Electronics Letters, Oct. 30, 1975, page 532. Also two out-of-phase transducers as well as voice coils and magnets have been used in such microphones.

The differential microphone of this invention utilizes a transducer mounted substantially flush with a circumferentially extending plate. The plate has a plurality of bores extending through it and serves to increase the time delay of an acoustic signal to the rear entry of the transducer and thereby reduce the cancellation of the desired or voice sound source. The bores in the plate allow high-frequency sounds to have better access to both sides of the transducer to smooth close-talk high-frequency signals.

Accordingly, it is an object of this invention to provide for a novel differential microphone.

Another object of this invention is to provide for a differential microphone which effectively increases the time delay of close source sound signals to the rear of the microphone transducer.

Another object of this invention is to provide for a differential microphone which effectively cancels unwanted distant sound and improves close-source sounds.

Other objects of this invention will become apparent upon a reading of the following description.

BRIEF DESCRIPTION OF THE DRAWINGS

A preferred embodiment of the invention has been chosen for purposes of illustration wherein.

DESCRIPTION OF THE PREFERRED EMBODIMENT

Figure 1:
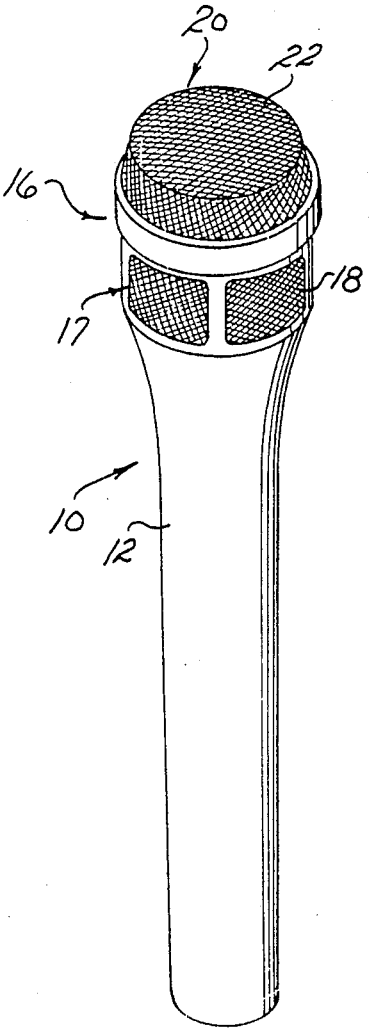
FIG. 1 is a perspective view of the microphone of this invention.
Figure 2:
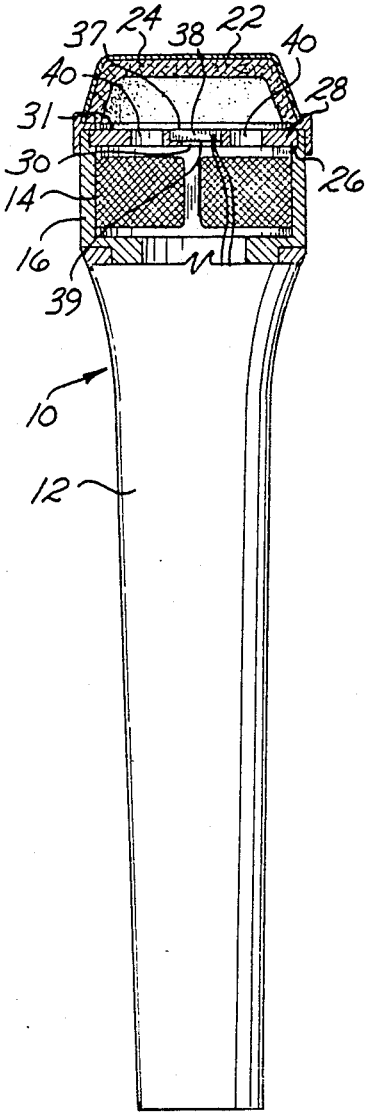
FIG. 2 is an elevational view of the microphone with portions shown in sectionalized form.

The preferred embodiment herein described is not intended to be exhaustive or to limit the invention to the precise form disclosed. It is chosen and described to explain the principles of the invention and its application and practical use to enable others skilled in the art to utilize the invention.

The microphone 10 of this invention includes a handle part 12. A sound-receiving chamber 14 is defined by a microphone housing 16 positioned atop handle 12. Housing 16 includes side openings 17 covered by a mesh grille 18 and an open top 20. A mesh grille 22 having a foam inner layer 24 covers top 20 of housing 16. Handle part 12 may include the circuitry and battery power for microphone 10.

Figure 3:
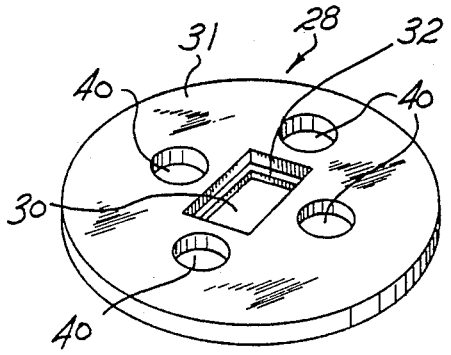
FIG. 3 is a perspective view of the plate used in the microphone.
Figure 4:
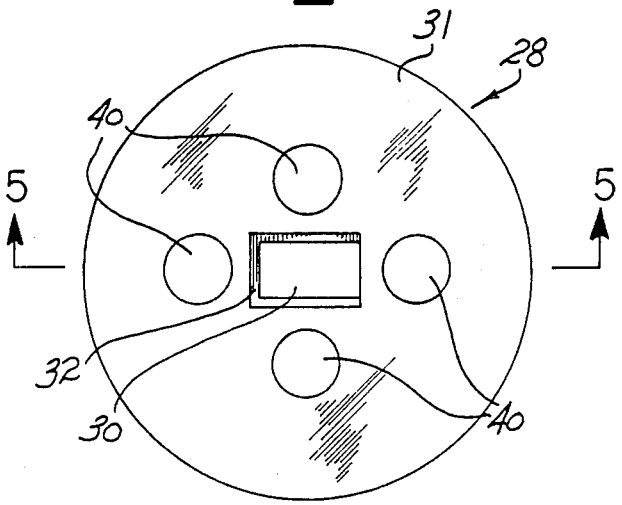
FIG. 4 is a plan view of the plate.
Figure 5:
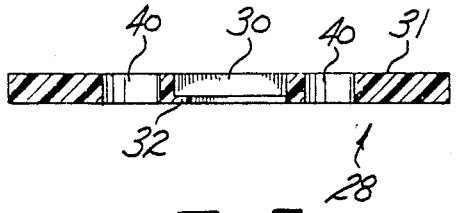
FIG. 5 is a sectional view taken along line 5—5 of FIG. 4

Housing 16 includes at its top 20 an inner peripheral continuous shoulder 26. A plate 28 of the general shape shown in FIGS. 3–5 is positioned within sound chamber 14 and is supported by housing shoulder 26. Plate 28 includes a central hole 30 extending from a face 31 through the plate. A shoulder 32 extends peripherally about three sides of hole 30 within plate 28 to form a support shelf. A transducer 38 is supported atop shoulder 32. Transducer 38 is of substantially uniform composition, allowing sound to enter at both the front 37 and rear 39 of the transducer. One or more bores 40 are located in plate 28 about hole 30. Bores 40 permit high-frequency sounds to have better access to both sides of transducer 38. The number and size of bores 40 will vary depending on the desired microphone high frequency response.

Microphone 10 operates as follows. When a person speaks into microphone 10 at approximately one inch or so from grille 22, sounds from the person's voice are delayed in arriving at the rear 39 of transducer to reduce cancellation of these sounds and thus improve sound quality. Bores 40 in plate 28 allow some sound to pass directly through the plate to raise the high frequency response of the microphone. Sounds arriving at the sides of transducer 38 are simultaneously received and cancelled.

It is to be understood that the above description does not limit the invention to that precise form, but may be modified within the scope of the appended claims.

I claim:

1. A microphone comprising a housing, said housing defining a sound receiving chamber having spaced openings for receiving sound waves, a plate positioned within and extending across said sound-receiving chamber between said openings, a transducer having first and second sound receiving entries carried by said plate with said transducer first entry located at one side of said plate and said transducer second entry located at the other side of the plate, said plate constituting means for delaying sound waves from a microphone user entering one of said transducer entries.

2. The microphone of claim 1 and a bore through said plate spaced from said transducer, said bore constituting means to reduce the delay of some of said user sound waves entering said one transducer entry.

3. The microphone of claim 2 and other bores through said plate spaced from said transducer.

* * * * *